US011694591B2

(12) United States Patent
Hong et al.

(10) Patent No.: US 11,694,591 B2
(45) Date of Patent: Jul. 4, 2023

(54) DISPLAY DEVICE INCLUDING DUAL DATA LINES AND METHOD OF DRIVING THE SAME

(71) Applicant: LG Display Co., Ltd., Seoul (KR)

(72) Inventors: Soon-Hwan Hong, Paju-si (KR); Dae-Seok Oh, Paju-si (KR); Seong-Yeong Kim, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/556,952

(22) Filed: Dec. 20, 2021

(65) Prior Publication Data

US 2022/0208063 A1 Jun. 30, 2022

(30) Foreign Application Priority Data

Dec. 24, 2020 (KR) ..... 10-2020-0183599

(51) Int. Cl.
*G09G 3/20* (2006.01)
*G09G 3/3225* (2016.01)

(52) U.S. Cl.
CPC ..... *G09G 3/2003* (2013.01); *G09G 3/3225* (2013.01); *G09G 2310/0264* (2013.01); *G09G 2320/0673* (2013.01)

(58) Field of Classification Search
CPC ... G09G 2310/0264; G09G 2320/0673; G09G 3/2003; G09G 3/3225; G09G 2300/0443; G09G 2300/0452; G09G 2310/08; G09G 2320/0219
See application file for complete search history.

(56) References Cited

U.S. PATENT DOCUMENTS

2013/0021229 A1* 1/2013 Ludden ..... G09G 3/3688 345/89
2016/0078836 A1* 3/2016 Kim ..... G09G 3/3688 345/209
2016/0189657 A1* 6/2016 Oh ..... G09G 3/3688 345/88
2016/0322008 A1* 11/2016 Sang ..... G09G 3/3607

FOREIGN PATENT DOCUMENTS

KR 2020-0075972 * 6/2020

* cited by examiner

*Primary Examiner* — Kenneth Bukowski
(74) *Attorney, Agent, or Firm* — Fenwick & West LLP

(57) ABSTRACT

A display device includes: a timing controlling part generating an image data, a data control signal and a gate control signal; a data driving part generating a data voltage using the image data and the data control signal; a gamma part transmitting the data voltage corresponding to the image data; a gate driving part generating a gate voltage using the gate control signal; a display panel including subpixels, gate lines, left data lines at a left side of the subpixels and right data lines at a right side of the subpixels; and first MUX switches, second MUX switches, third MUX switches, fourth MUX switches, fifth MUX switches and sixth MUX switches sequentially transmitting the data voltage to the left data lines and the right data lines.

12 Claims, 7 Drawing Sheets

DISPLAY DEVICE INCLUDING DUAL DATA LINES AND METHOD OF DRIVING THE SAME

CROSS REFERENCE TO RELATED APPLICATIONS

The present application claims the priority benefit of Republic of Korea Patent Application No. 10-2020-0183599 filed in Republic of Korea on Dec. 24, 2020, which is hereby incorporated by reference herein in its entirety.

BACKGROUND

Technical Field

The present disclosure relates to a display device, and more particularly, to a display device including dual data lines where a data voltage is supplied to a subpixel through left and right data lines and a method of driving the display device.

Discussion of the Related Art

As the information age progresses, display devices have rapidly advanced. In a display device field, a conventional cathode ray tube (CRT) has been rapidly replaced by a flat panel display (FPD) device having a thin profile, a light weight and a low power consumption. The FPD device includes a liquid crystal display (LCD) device, a plasma display panel (PDP), an organic light emitting display (OLED) device and a field emission display (FED) device.

The display device displays an image by supplying a data voltage outputted from a data driving part to a pixel of a display panel. As a resolution increases, a number of pixels increases. As a result, a time of applying the data voltage to each pixel decreases and a time of charging a data line decreases.

In addition, as a number of the pixels increases, a size and a number of the data driving parts increase. As a result, a fabrication cost of the display device increases.

SUMMARY

Accordingly, the present disclosure is directed to a display device that substantially obviates one or more of the problems due to limitations and disadvantages of the related art.

An object of the present disclosure is to provide a display device including dual data lines where a sufficient charging time (a sampling time) for the dual data lines is obtained by supplying a data voltage to a subpixel of a display panel through the dual data lines of left and right data lines and a method of driving the display device.

Another object of the present disclosure is to provide a display device including dual data lines where the number of data driving parts decreases and a fabrication cost decreases and a method of driving the display device.

Another object of the present disclosure is to provide a display device including dual data line where the number of gamma circuit parts decreases and a fabrication cost decreases by supplying a data voltage sequentially outputted from an output terminal of a data driving part to three subpixels of a display panel using a multiplexer and a method of driving the display device.

Additional features and advantages of the disclosure will be set forth in the description which follows, and in part will be apparent from the description, or may be learned by practice of the disclosure. These and other advantages of the disclosure will be realized and attained by the structure particularly pointed out in the written description and claims hereof as well as the appended drawings.

To achieve these and other advantages and in accordance with the purpose of the present disclosure, as embodied and broadly described herein, a display device includes: a timing controlling part generating an image data, a data control signal and a gate control signal; a data driving part generating a data voltage using the image data and the data control signal; a gamma part transmitting the data voltage corresponding to the image data; a gate driving part generating a gate voltage using the gate control signal; a display panel including a plurality of subpixels, a plurality of gate lines transmitting the gate voltage to the plurality of subpixels, a plurality of left data lines transmitting the data voltage to the plurality of subpixels and disposed at a left side of the plurality of subpixels and a plurality of right data lines transmitting the data voltage to the plurality of subpixels and disposed at a right side of the plurality of subpixels; and a plurality of first MUX switches, a plurality of second MUX switches, a plurality of third MUX switches, a plurality of fourth MUX switches, a plurality of fifth MUX switches and a plurality of sixth MUX switches sequentially transmitting the data voltage to the plurality of left data lines and the plurality of right data lines.

In another aspect, a method of driving a display device includes: generating an image data, a data control signal and a gate control signal; generating a data voltage using the image data and the data control signal; generating a gate voltage using the gate control signal; sequentially transmitting the data voltage to a plurality of left data lines disposed at a left side of a plurality of subpixels and a plurality of right data lines disposed at a right side of the plurality of subpixels through a plurality of first MUX switches, a plurality of second MUX switches, a plurality of third MUX switches, a plurality of fourth MUX switches, a plurality of fifth MUX switches and a plurality of sixth MUX switches; and displaying an image in the plurality of subpixels using the data voltage and the gate voltage.

It is to be understood that both the foregoing general description and the following detailed description are explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this specification, illustrate embodiments of the disclosure and together with the description serve to explain the principles of the disclosure. In the drawings.

DETAILED DESCRIPTION

Figure 1:
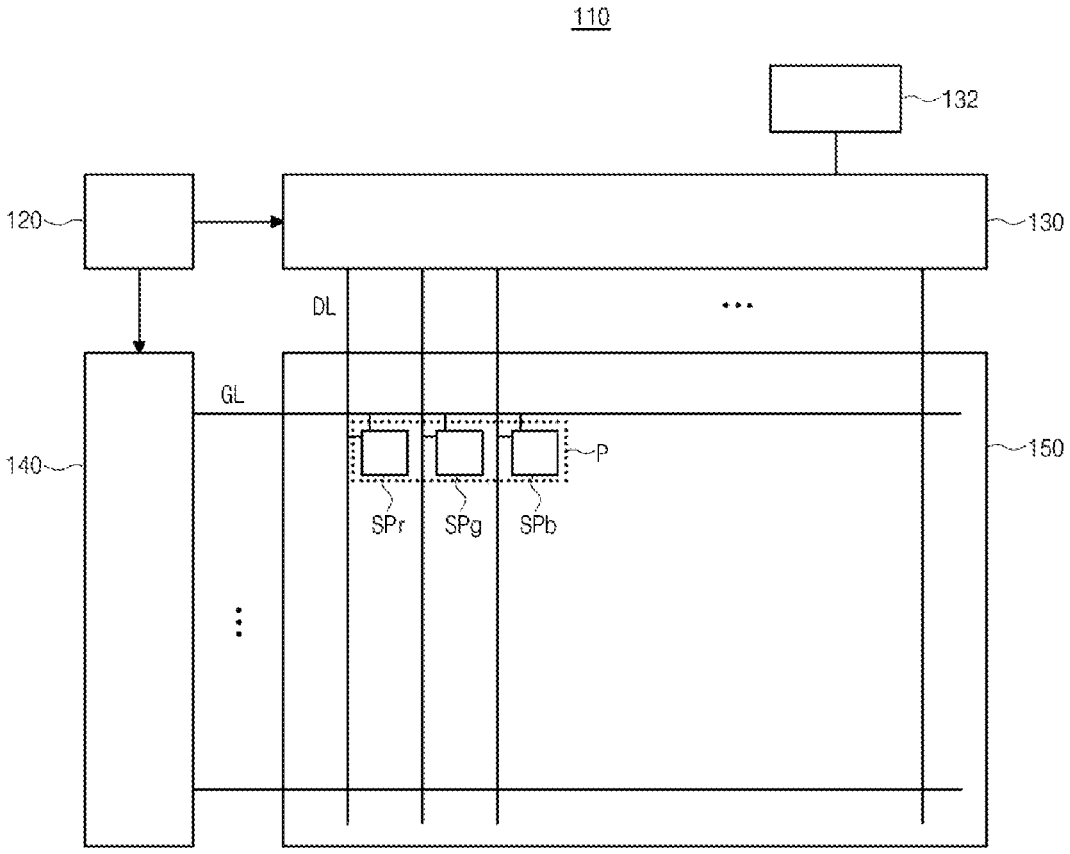
FIG. 1 is a view showing a display device according to a first embodiment of the present disclosure.

Advantages and features of the present disclosure, and implementation methods thereof will be clarified through following example embodiments described with reference to the accompanying drawings. The present disclosure may, however, be embodied in different forms and should not be construed as limited to the example embodiments set forth herein. Rather, these example embodiments are provided so that this disclosure may be sufficiently thorough and complete to assist those skilled in the art to fully understand the scope of the present disclosure. Further, the present disclosure is only defined by scopes of claims.

A shape, a size, a ratio, an angle, and a number disclosed in the drawings for describing embodiments of the present disclosure are merely an example. Thus, the present disclosure is not limited to the illustrated details. Like reference numerals refer to like elements throughout. In the following description, when the detailed description of the relevant known function or configuration is determined to unnecessarily obscure an important point of the present disclosure, the detailed description of such known function or configuration may be omitted. In a case where terms "comprise," "have," and "include" described in the present specification are used, another part may be added unless a more limiting term, such as "only," is used. The terms of a singular form may include plural forms unless referred to the contrary.

In construing an element, the element is construed as including an error or tolerance range even where no explicit description of such an error or tolerance range.

In describing a position relationship, when a position relation between two parts is described as, for example, "on," "over," "under," or "next," one or more other parts may be disposed between the two parts unless a more limiting term, such as "just" or "direct(ly)," is used.

It will be understood that, although the terms "first," "second," etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

Features of various embodiments of the present disclosure may be partially or overall coupled to or combined with each other, and may be variously inter-operated with each other and driven technically as those skilled in the art can sufficiently understand. Embodiments of the present disclosure may be carried out independently from each other, or may be carried out together in co-dependent relationship.

Hereinafter, a touch display device according to embodiments of the present disclosure will be described in detail with reference to the accompanying drawings. In the following description, same reference numerals designate same elements throughout. When a detailed description of well-known functions or configurations related to this document is determined to unnecessarily cloud a gist of the inventive concept, the detailed description thereof will be omitted or will be made brief.

FIG. 1 is a view showing a display device according to a first embodiment of the present disclosure. The display device may include an organic light emitting diode (OLED) display device.

In FIG. 1, a display device 110 according to a first embodiment of the present disclosure includes a timing controlling part 120, a data driving part 130, a gamma part 132, a gate driving part 140 and a display panel 150.

The timing controlling part 120 generates an image data, a data control signal and a gate control signal using an image signal and a plurality of timing signals of a data enable signal, a horizontal synchronization signal, a vertical synchronization signal, and a clock transmitted from an external system (not shown) such as a graphic card or a television system. The timing controlling part 120 transmits the image data and the data control signal to the data driving part 130 and transmits the gate control signal to the gate driving part 140.

The data driving part 130 generates a data voltage (a data signal) using the data control signal and the image data transmitted from the timing controlling part 120 and applies the data voltage to a data line DL of the display panel 150.

The gamma part 132 transmits the data voltage corresponding to the image data of the data driving part 130 to the data driving part 130.

The gate driving part 140 generates a gate voltage (a gate signal) using the gate control signal transmitted from the timing controlling part 120 and applies the gate voltage to a gate line GL of the display panel 150.

The gate driving part 140 may have a gate-in-panel (GIP) type where the gate driving part 140 is disposed on a substrate of the display panel 150 having the gate line GL, the data line DL and a pixel P.

The display panel 150 displays an image using the gate voltage and the data voltage and includes a plurality of pixels P, a plurality of gate lines GL and a plurality of data lines DL.

Each of the plurality of pixels P includes red, green and blue subpixels SPr, SPg and SPb. The gate line GL and the data line DL cross each other to define the red, green and blue subpixels SPr, SPg and SPb, and each of the red, green and blue subpixels SPr, SPg and SPb is connected to the gate line GL and the data line DL.

When the display device 110 is an OLED display device, each of the red, green and blue subpixels SPr, SPg and SPb may include a plurality of thin film transistors (TFTs) such as a switching TFT, a driving TFT and a sensing TFT, a storage capacitor and a light emitting diode.

Each subpixel of the display panel 150 will be illustrated with reference to drawings.

Figure 2:
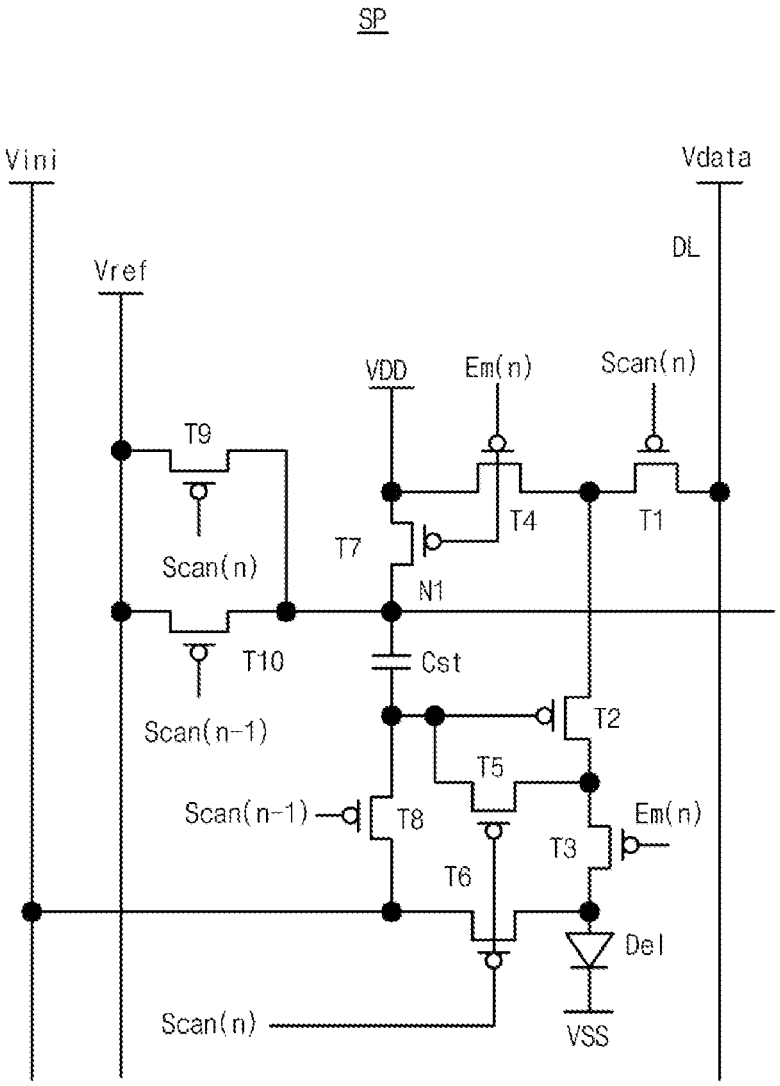
FIG. 2 is a view showing a subpixel of a display device according to a first embodiment of the present disclosure.

FIG. 2 is a view showing a subpixel of a display device according to a first embodiment of the present disclosure.

In FIG. 2, each of the red, green and blue subpixels SPr, SPg and SPb of the display panel 150 of the display device 110 according to a first embodiment of the present disclosure includes first to tenth transistors T1 to T10, a storage capacitor Cst and a light emitting diode Del.

For example, the first to tenth transistors T1 to T10 may be positive (P) type.

The first transistor T1 of a switching transistor may be switched according to an (n)th gate voltage Scan(n) to transmit a data voltage Vdata. A gate electrode of the first transistor T1 receives the (n)th gate voltage Scan(n) of an (n)th gate line, a source electrode of the first transistor T1 is connected to a data line DL, and a drain electrode of the first transistor T1 is connected to source electrodes of the second and fourth transistors T2 and T4.

The second transistor T2 of a driving transistor may be switched according to a voltage of a first electrode of the storage capacitor Cst. A gate electrode of the second transistor T2 is connected to the first electrode of the storage capacitor Cst, a drain electrode of the fifth transistor T5 and a source electrode of the eighth transistor T8, a source electrode of the second transistor T2 is connected to a drain electrode of the first transistor T1 and a source electrode of the fourth transistor T4, and a drain electrode of the second transistor T2 is connected to source electrodes of the third and fifth transistors T3 and T5.

The third transistor T3 may be switched according to an (n)th emission voltage Em(n). A gate electrode of the third transistor T3 receives the (n)th emission voltage Em(n), a source electrode of the third transistor T3 is connected to a drain electrode of the second transistor T2 and a source electrode of the fifth transistor T5, and a drain electrode of the third transistor T3 is connected to source electrodes of the sixth transistor T6 and an anode of the light emitting diode Del.

The fourth transistor T4 may be switched according to an (n)th emission voltage Em(n). A gate electrode of the fourth transistor T4 receives the (n)th emission voltage Em(n), a source electrode of the fourth transistor T4 is connected to a drain electrode of the first transistor T1 and a source electrode of the second transistor T2, and a drain electrode of the fourth transistor T4 receives a high level voltage VDD and is connected to a source electrode of the seventh transistor T7.

The fifth transistor T5 may be switched according to an (n)th gate voltage Scan(n). A gate electrode of the fifth transistor T5 receives the (n)th gate voltage Scan(n), a source electrode of the fifth transistor T5 is connected to a drain electrode of the second transistor T2 and a source electrode of the third transistor T3, and a drain electrode of the fifth transistor T5 is connected to a gate electrode of the second transistor T2, a first electrode of the storage capacitor Cst and a source electrode of the eighth transistor T8.

The sixth transistor T6 may be switched according to an (n)th gate voltage Scan(n). A gate electrode of the sixth transistor T6 receives the (n)th gate voltage Scan(n), a source electrode of the sixth transistor T6 is connected to a drain electrode of the third transistor T3 and an anode of the light emitting diode Del, and a drain electrode of the sixth transistor T6 receives an initialization voltage Vini and is connected to a drain electrode of the eighth transistor T8.

The seventh transistor T7 may be switched according to an (n)th emission voltage Em(n). A gate electrode of the seventh transistor T7 receives the (n)th emission voltage Em(n), a source electrode of the seventh transistor T7 receives a high level voltage VDD, and a drain electrode of the seventh transistor T7 is connected to a second electrode of the storage capacitor Cst and source electrodes of the ninth and tenth transistors T9 and T10.

The eighth transistor T8 may be switched according to an (n−1)th gate voltage Scan(n−1). A gate electrode of the eighth transistor T8 receives the (n−1)th gate voltage Scan (n−1), a source electrode of the eighth transistor T8 is connected to a first electrode of the storage capacitor Cst, a gate electrode of the second transistor T2 and a drain electrode of the fifth transistor T5, and a drain electrode of the eighth transistor T8 receives an initialization voltage Vini and is connected to a drain electrode of the sixth transistor T6.

The ninth transistor T9 may be switched according to an (n)th gate voltage Scan(n). A gate electrode of the ninth transistor T9 receives the (n)th gate voltage Scan(n), a source electrode of the ninth transistor T9 is connected to a second electrode of the storage capacitor Cst and a drain electrode of the seventh transistor T7, and a drain electrode of the ninth transistor T9 receives a reference voltage Vref.

The tenth transistor T10 may be switched according to an (n−1)th gate voltage Scan(n−1). A gate electrode of the tenth transistor T10 receives the (n−1)th gate voltage Scan(n−1), a source electrode of the tenth transistor T10 is connected to a second electrode of the storage capacitor Cst and a drain electrode of the seventh transistor T7, and a drain electrode of the tenth transistor T10 receives a reference voltage Vref.

The light emitting diode Del is connected between the third transistor T3 and a low level voltage VSS and emits a light of a luminance proportional to a current of the second transistor T2.

The light emitting diode Del emits the light according to operation of the first to tenth transistors T1 to T10 and the storage capacitor Cst to display an image. In addition, the display device 110 may compensate variation of a threshold voltage or deterioration of the light emitting diode according to a duration time using the subpixel. In addition, the display device 110 may control a luminance by driving the light emitting diode Del according to a duty ratio corresponding to an emission time.

The data driving part, the gamma part and the display panel of the display device 110 will be illustrated with reference to drawings.

Figure 3:
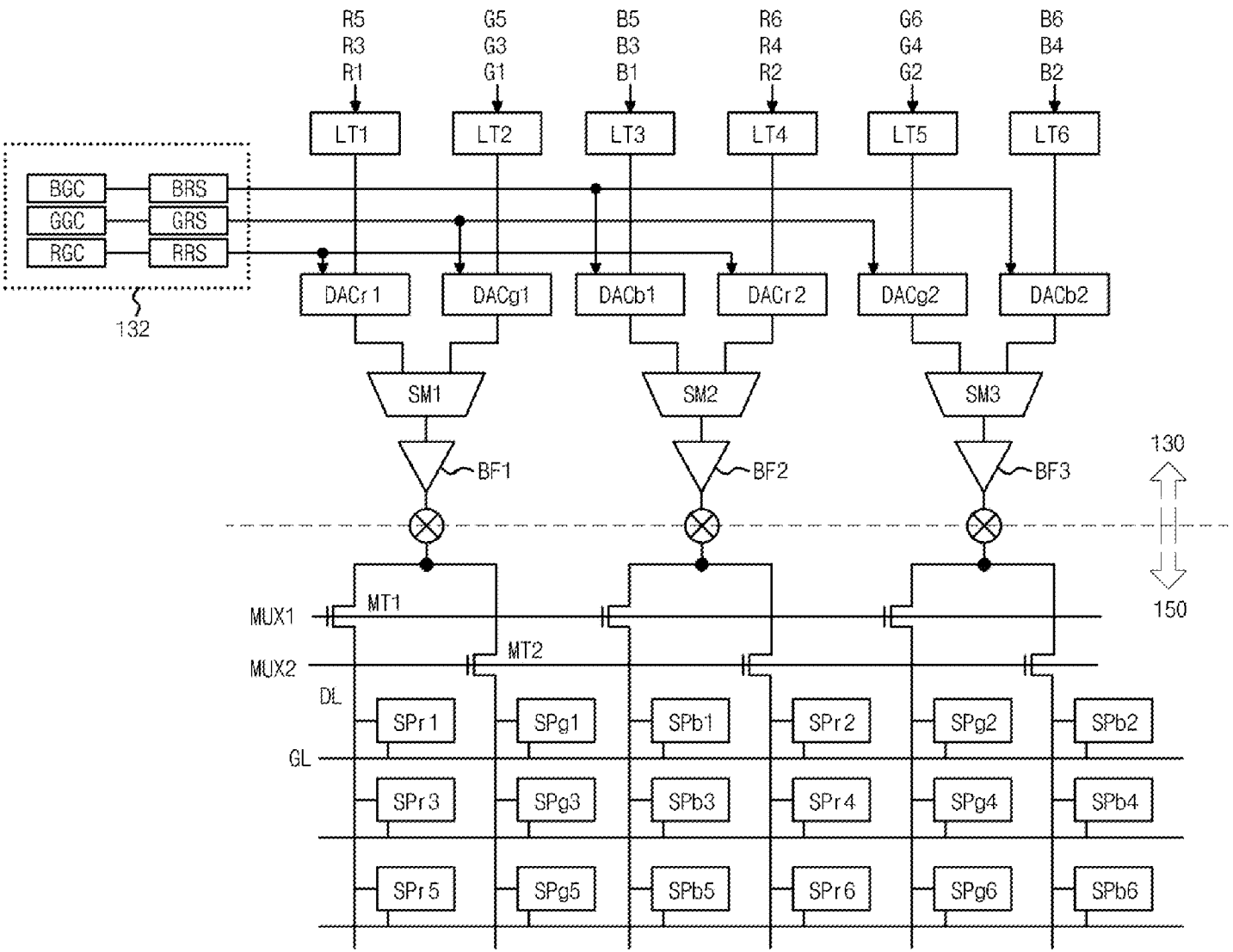
FIG. 3 is a view showing a data driving part, a gamma part and a display panel of a display device according to a first embodiment of the present disclosure.

FIG. 3 is a view showing a data driving part, a gamma part and a display panel of a display device according to a first embodiment of the present disclosure.

In FIG. 3, the data driving part 130 of the display device 110 according to a first embodiment of the present disclosure may include a plurality of latches LT1 to LT6, a plurality of red digital analog converters DACr1 and DACr2, a plurality of green digital analog converters DACg1 and DACg2, a plurality of blue digital analog converters DACb1 and DACb2, a plurality of source multiplexers (MUXs) SM1, SM2 and SM3 and a plurality of buffers BF1, BF2 and BF3. The gamma part 132 of the display device 110 according to a first embodiment of the present disclosure may include red, green and blue gamma circuits RGC, GGC and BGC and red, green and blue resistor strings RRS, GRS and BRS. The display panel 150 of the display device 110 according to a first embodiment of the present disclosure may include a plurality of first MUX switches MT1, a plurality of second MUX switches MT2, a plurality of red subpixels SPr, a plurality of green subpixels SPg and a plurality of blue subpixels SPb.

The data driving part 130 may be connected to a non-display area surrounding a display area of the display panel 150. The plurality of first MUX switches MT1 and the plurality of second MUX switches MT2 may be disposed in the non-display area of the display panel 150.

The plurality of latches LT1 to LT6 sequentially receive image data of each color from the timing controlling part 120 and store the image data of each color for a time corresponding to one clock. Next, the plurality of latches LT1 to LT6 sequentially output the image data of each color to the plurality of red digital analog converters DACr1 and DACr2, the plurality of green digital analog converters DACg1 and DACg2 and the plurality of blue digital analog converters DACb1 and DACb2 through the plurality of source MUXs SM1, SM2 and SM3.

For example, first, third and fifth red image data R1, R3 and R5 may be sequentially inputted to and sequentially outputted from the first latch LT1, first, third and fifth green image data G1, G3 and G5 may be sequentially inputted to and sequentially outputted from the second latch LT2, and first, third and fifth blue image data B1, B3 and B5 may be sequentially inputted to and sequentially outputted from the third latch LT3. Second, fourth and sixth red image data R2, R4 and R6 may be sequentially inputted to and sequentially outputted from the fourth latch LT4. Second, fourth and sixth green image data G2, G4 and G6 may be sequentially inputted to and sequentially outputted from the fifth latch LT5, and second, fourth and sixth blue image data B2, B4 and B6 may be sequentially inputted to and sequentially outputted from the sixth latch LT6.

The plurality of red digital analog converters DACr1 and DACr2, the plurality of green digital analog converters DACg1 and DACg2 and the plurality of blue digital analog converters DACb1 and DACb2 convert the image data inputted from the plurality of latches LT1 to LT6 into a data voltage and sequentially output the data voltage.

For example, the first red digital analog converter DACr1 may convert the first, third and fifth red image data R1, R3 and R5 of the first latch LT1 into first, third and fifth red data voltages Vr1, Vr3 and Vr5 and may transmit the first, third and fifth red data voltages Vr1, Vr3 and Vr5 to the first source MUX SM1. The first green digital analog converter DACg1 may convert the first, third and fifth green image data G1, G3 and G5 of the second latch LT2 into first, third and fifth green data voltages Vg1, Vg3 and Vg5 and may transmit the first, third and fifth green data voltages Vg1, Vg3 and Vg5 to the first source MUX SM1. The first blue digital analog converter DACb1 may convert the first, third and fifth blue image data B1, B3 and B5 of the third latch LT3 into first, third and fifth blue data voltages Vb1, Vb3 and Vb5 and may transmit the first, third and fifth blue data voltages Vb1, Vb3 and Vb5 to the second source MUX SM2. The second red digital analog converter DACr2 may convert the second, fourth and sixth red image data R2, R4 and R6 of the fourth latch LT4 into second, fourth and sixth red data voltages Vr2, Vr4 and Vr6 and may transmit the second, fourth and sixth red data voltages Vr2, Vr4 and Vr6 to the second source MUX SM2. The second green digital analog converter DACg2 may convert the second, fourth and sixth green image data G2, G4 and G6 of the fifth latch LT5 into second, fourth and sixth green data voltages Vg2, Vg4 and Vg6 and may transmit the second, fourth and sixth green data voltages Vg2, Vg4 and Vg6 to the third source MUX SM3. The second blue digital analog converter DACb2 may convert the second, fourth and sixth blue image data B2, B4 and B6 of the sixth latch LT6 into second, fourth and sixth blue data voltages Vb2, Vb4 and Vb6 and may transmit the second, fourth and sixth blue data voltages Vb2, Vb4 and Vb6 to the third source MUX SM3.

The plurality of red digital analog converters DACr1 and DACr2, the plurality of green digital analog converters DACg1 and DACg2 and the plurality of blue digital analog converters DACb1 and DACb2 convert the image data into the data voltages using the red, green and blue gamma circuits RGC, GGC and BGC and the red, green and blue resistor strings RRS, GRS and BRS.

Each of the red, green and blue gamma circuits RGC, GGC and BGC may store a corresponding relation of the red, green and blue image data of a digital value and the data voltages of an analog value. The red, green and blue gamma circuits RGC, GGC and BGC receive the red, green and blue image data from the plurality of red digital analog converters DACr1 and DACr2, the plurality of green digital analog converters DACg1 and DACg2 and the plurality of blue digital analog converters DACb1 and DACb2 and control the red, green and blue resistor strings RRS, GRS and BRS to transmit the data voltages corresponding to the red, green and blue image data to the plurality of red digital analog converters DACr1 and DACr2, the plurality of green digital analog converters DACg1 and DACg2 and the plurality of blue digital analog converters DACb1 and DACb2.

Each of the red, green and blue resistor strings RRS, GRS and BRS may include a plurality of resistors connected to each other in series. The red, green and blue resistor strings RRS, GRS and BRS output the data voltages corresponding to the red, green and blue image data from connection nodes between adjacent two of the plurality of resistors to the plurality of red digital analog converters DACr1 and DACr2, the plurality of green digital analog converters DACg1 and DACg2 and the plurality of blue digital analog converters DACb1 and DACb2.

Each of the plurality of red digital analog converters DACr1 and DACr2, the plurality of green digital analog converters DACg1 and DACg2 and the plurality of blue digital analog converters DACb1 and DACb2 may convert the image data of one color into the data voltage. As a result, each of the plurality of red digital analog converters DACr1 and DACr2, the plurality of green digital analog converters DACg1 and DACg2 and the plurality of blue digital analog converters DACb1 and DACb2 may be connected to one gamma circuit RGC, GGC and BGC and one resistor string RRS, GRS and BRS.

Each of the plurality of source MUXs SM1, SM2 and SM3 sequentially transmits the data voltage of one color outputted from adjacent two of the plurality of red digital analog converters DACr1 and DACr2, the plurality of green digital analog converters DACg1 and DACg2 and the plurality of blue digital analog converters DACb1 and DACb2 to each of the plurality of buffers BF1, BF2 and BF3 at different timings.

For example, the first source MUX SM1 may sequentially transmit the first, third and fifth red data voltages Vr1, Vr3 and Vr5 of the first red digital analog converter DACr1 to the first buffer BF1 and may sequentially transmit the first, third and fifth green data voltages Vg1, Vg3 and Vg5 of the first green digital analog converter DACg1 to the first buffer BF1.

The second source MUX SM2 may sequentially transmit the first, third and fifth blue data voltages Vb1, Vb3 and Vb5 of the first blue digital analog converter DACb1 to the second buffer BF2 and may sequentially transmit the second, fourth and sixth red data voltages Vr2, Vr4 and Vr6 of the second red digital analog converter DACr2 to the second buffer BF2.

The third source MUX SM3 may sequentially transmit the second, fourth and sixth green data voltages Vg2, Vg4 and Vg6 of the second green digital analog converter DACg2 to the third buffer BF3 and may sequentially transmit the second, fourth and sixth blue data voltages Vb2, Vb4 and Vb6 of the second blue digital analog converter DACb2 to the third buffer BF3.

The plurality of buffers BF1, BF2 and BF3 stabilize the plurality of data voltages received from the plurality of source MUXs SM1, SM2 and SM3 and sequentially output the plurality of data voltages through an output terminal (a channel).

For example, the first buffer BF1 may sequentially output the first red, first green, third red, third green, fifth red and fifth green data voltages Vr1, Vg1, Vr3, Vg3, Vr5 and Vg5 of the first source MUX SM1 through a first output terminal. The second buffer BF2 may sequentially output the first blue, second red, third blue, fourth red, fifth blue and sixth red data voltages Vb1, Vr2, Vb3, Vr4, Vb5 and Vr6 of the second source MUX SM2 through a second output terminal. The third buffer BF3 may sequentially output the second green, second blue, fourth green, fourth blue, sixth green and sixth blue data voltages Vg2, Vb2, Vg4, Vb4, Vg6 and Vb6 of the third source MUX SM3 through a third output terminal.

The plurality of first MUX switches MT1 and the plurality of second MUX switches MT2 sequentially transmit the plurality of data voltages outputted from the plurality of buffers BF1, BF2 and BF3 to the plurality of data lines DL according to first and second MUX signals MUX1 and MUX2.

For example, according the first MUX signal MUX1, the plurality of first MUX switches MT1 may sequentially transmit the first red, third red and fifth red data voltages Vr1, Vr3 and Vr5 of the first buffer BF1 to a first data line, may sequentially transmit the first blue, third blue and fifth blue data voltages Vb1, Vb3 and Vb5 of the second buffer BF2 to a third data line, and may sequentially transmit the second green, fourth green and sixth green data voltages Vg2, Vg4 and Vg6 of the third buffer BF3 to a fifth data line.

According the second MUX signal MUX2, the plurality of second MUX switches MT2 may sequentially transmit the first green, third green and fifth green data voltages Vg1, Vg3 and Vg5 of the first buffer BF1 to a second data line, may sequentially transmit the second red, fourth red and sixth red data voltages Vr2, Vr4 and Vr6 of the second buffer BF2 to a fourth data line, and may sequentially transmit the second blue, fourth blue and sixth blue data voltages Vb2, Vb4 and Vb6 of the third buffer BF3 to a sixth data line.

The plurality of red subpixels SPr, the plurality of green subpixels SPg and the plurality of blue subpixels SPb display an image using the plurality of data voltages transmitted through the plurality of first MUX switches MT1, the plurality of second MUX switches MT2 and the plurality of data lines DL.

Each of the red, green and blue subpixels SPr, SPg and SPb is connected to the data line DL and the gate line GL such that the source electrode and the gate electrode of the first transistor T1 (of FIG. 2) in each of the red, green and blue subpixels SPr, SPg and SPb are connected to the data line DL and the gate line GL, respectively.

For example, the first red, first green, first blue, second red, second green and second blue subpixels SPr1, SPg1, SPb1, SPr2, SPg2 and SPb2 in a first horizontal pixel line may emit lights of luminance corresponding to the first red, first green, first blue, second red, second green and second blue data voltages Vr1, Vg1, Vb1, Vr2, Vg2 and Vb2, respectively. The third red, third green, third blue, fourth red, fourth green and fourth blue subpixels SPr3, SPg3, SPb3, SPr4, SPg4 and SPb4 in a second horizontal pixel line may emit lights of luminance corresponding to the third red, third green, third blue, fourth red, fourth green and fourth blue data voltages Vr3, Vg3, Vb3, Vr4, Vg4 and Vb4, respectively. The fifth red, fifth green, fifth blue, sixth red, sixth green and sixth blue subpixels SPr5, SPg5, SPb5, SPr6, SPg6 and SPb6 in a third horizontal pixel line may emit lights of luminance corresponding to the fifth red, fifth green, fifth blue, sixth red, sixth green and sixth blue data voltages Vr5, Vg5, Vb5, Vr6, Vg6 and Vb6, respectively.

In the first horizontal pixel line, the first red, first blue and second green data voltages Vr1, Vb1 and Vg2 are simultaneously transmitted to the first red, first blue and second green subpixels SPr1, SPb1 and SPg2, respectively, and the first green, second red and second blue data voltages Vg1, Vr2 and Vb2 are simultaneously transmitted to the first green, second red and second blue subpixels SPg1, SPr2 and SPb2, respectively.

As a result, in each of the plurality of horizontal pixel lines, the data voltage is transmitted to a left one of adjacent two of the red, green and blue subpixels SPr, SPg and SPb and is transmitted to a right one of the adjacent two of the red, green and blue subpixels SPr, SPg and SPb later.

In the display device 110 according to a first embodiment of the present disclosure, the plurality of data voltages sequentially outputted from one output terminal (one channel) of the data driving part 130 are sequentially transmitted to the two adjacent subpixels in one horizontal pixel line through the plurality of first MUX switches MT1 and the plurality of second MUX switches MT2 of the display panel 150.

Accordingly, since the number of the output terminals (a number of pins) of the data driving part 130 is reduced, the number of the required data driving parts (integrated circuits) 130 is reduced and a fabrication cost is reduced.

In the display device 110 according to a first embodiment of the present disclosure, since the data voltages of one output terminal of the data driving part 130 are transmitted to two data lines DL through the plurality of first MUX switches MT1 and the plurality of second MUX switches MT2, increase of a number of pixels due to increase of resolution is not sufficiently managed. As a result, a number of the data driving part 130 may not be sufficiently reduced and a charging time of the data voltage for the data line may not be sufficiently obtained.

Further, in the display device 110 according to a first embodiment of the present disclosure, for simplification of driving elements, first nodes N1 (of FIG. 2) of the adjacent red, green and blue subpixels SPr, SPg and SPb are connected through a transmission line, and the reference voltage Vref (of FIG. 2) is supplied to the red, green and blue subpixels SPr, SPg and SPb through a pair of the ninth and tenth transistors T9 and T10 (of FIG. 2). As a result, the transmission line and the data line DL of each of the red, green and blue subpixels SPr, SPg and SPb overlap each other to constitute a parasitic capacitance. Here, during a period where the light emitting diode Del does not emit a light according to a duty ratio, since the seventh transistor T7 is turned off according to the emission voltage Em(n) corresponding to an off, the high level voltage VDD is not applied to the first node N1 and the first node N1 may have a floating state. As a result, after the first red, first blue and second green data voltages Vr1, Vb1 and Vg2 are transmitted to the subpixels in the present horizontal pixel line through the data line DL, the first red, first blue and second green data voltages Vr1, Vb1 and Vg2 charged in the subpixel may vary to cause a color difference while the first red, first blue and second green data voltages Vr1, Vb1 and Vg2 are transmitted to the subpixels in the next horizontal pixel line through the data line DL.

In a display device according to a second embodiment of the present disclosure, since data voltages are sequentially transmitted to a subpixel using first to sixth MUX switches and left and right data lines, drawbacks may be improved. The display device according to a second embodiment of the present disclosure will be illustrated with reference to drawings.

Figure 4:
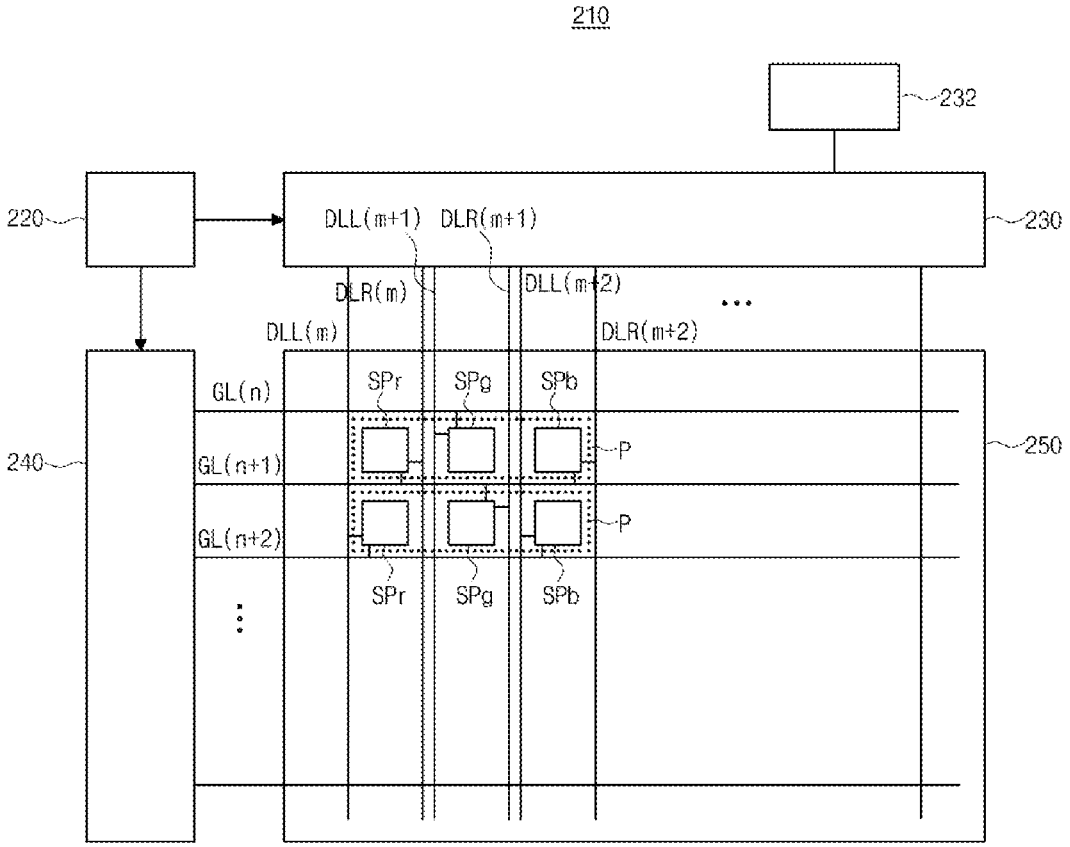
FIG. 4 is a view showing a display device according to a second embodiment of the present disclosure.

FIG. 4 is a view showing a display device according to a second embodiment of the present disclosure. The display device may include an electroluminescence display device. For example, the display device may include an organic light emitting diode (OLED) display device.

In FIG. 4, a display device 210 according to a second embodiment of the present disclosure includes a timing controlling part 220, a data driving part 230, a gamma part 232, a gate driving part 240 and a display panel 250.

The timing controlling part 220 generates an image data, a data control signal and a gate control signal using an image signal and a plurality of timing signals of a data enable signal, a horizontal synchronization signal, a vertical synchronization signal and a clock transmitted from an external system (not shown) such as a graphic card or a television system. The timing controlling part 220 transmits the image data and the data control signal to the data driving part 230 and transmits the gate control signal to the gate driving part 240.

The data driving part 230 generates a data voltage (a data signal) using the data control signal and the image data transmitted from the timing controlling part 220 and applies the data voltage to a left data line DLL and a right data line DLR of the display panel 250.

The gamma part 232 transmits the data voltage corresponding to the image data of the data driving part 230 to the data driving part 230.

The gate driving part 240 generates a gate voltage (a gate signal) using the gate control signal transmitted from the timing controlling part 220 and applies the gate voltage to a gate line GL of the display panel 250.

The gate driving part 240 may have a gate-in-panel (GIP) type where the gate driving part 240 is disposed on a substrate of the display panel 250 having the gate line GL, the data line DL and a pixel P.

The display panel 250 displays an image using the gate voltage and the data voltage. The display panel 250 includes a plurality of pixels P, a plurality of gate lines GL, a plurality of left data lines DLL and a plurality of right data lines DLR.

Each of the plurality of pixels P includes red, green and blue subpixels SPr, SPg and SPb. The gate line GL, the left data line DLL and the right data line DLR cross each other to define the red, green and blue subpixels SPr, SPg and SPb.

The red, green and blue subpixels SPr, SPg and SPb in one horizontal pixel line are alternately connected to two adjacent gate lines GL, and the red, green and blue subpixels SPr, SPg and SPb in one vertical pixel line are alternately connected to the left data line DLL and the right data line DLR.

For example, the left data line DLL and the right data line DLR may be disposed at a left side and a right side, respectively, of each of the red, green and blue subpixels SPr, SPg and SPb.

In the (n)th horizontal pixel line, the red subpixel SPr may be connected to the (n+1)th gate line GL(n+1) and the (m)th right data line DLR(m), the green subpixel SPg may be connected to the nth gate line GL(n) and the (m+1)th left data line DLL(m+1), and the blue subpixel SPb may be connected to the (n+1)th gate line GL(n+1) and the (m+2)th right data line DLR(m+2).

In the (n+1)th horizontal pixel line, the red subpixel SPr may be connected to the (n+2)th gate line GL(n+2) and the (m)th left data line, the green subpixel SPg may be connected to the (N+1)th gate line GL(N+1) and the (m+1)th right data line DLR(m+1), and the blue subpixel SPb may be connected to the (n+2)th gate line GL(n+2) and the (m+2)th left data line DLL(m+2).

When the display device 210 is an OLED display device, each of the red, green and blue subpixels SPr, SPg and SPb may include a plurality of thin film transistors (TFTs) such as a switching TFT, a driving TFT and a sensing TFT, a storage capacitor and a light emitting diode.

Although not shown, a power line where the high level voltage VDD (of FIG. 5) is applied may be disposed in the subpixel between the right data line DLR and the left data line DLL to block a coupling between the right data line DLR and the left data line DLL and to minimize a parasitic capacitance.

Each subpixel of the display panel 250 will be illustrated with reference to drawings.

Figure 5:
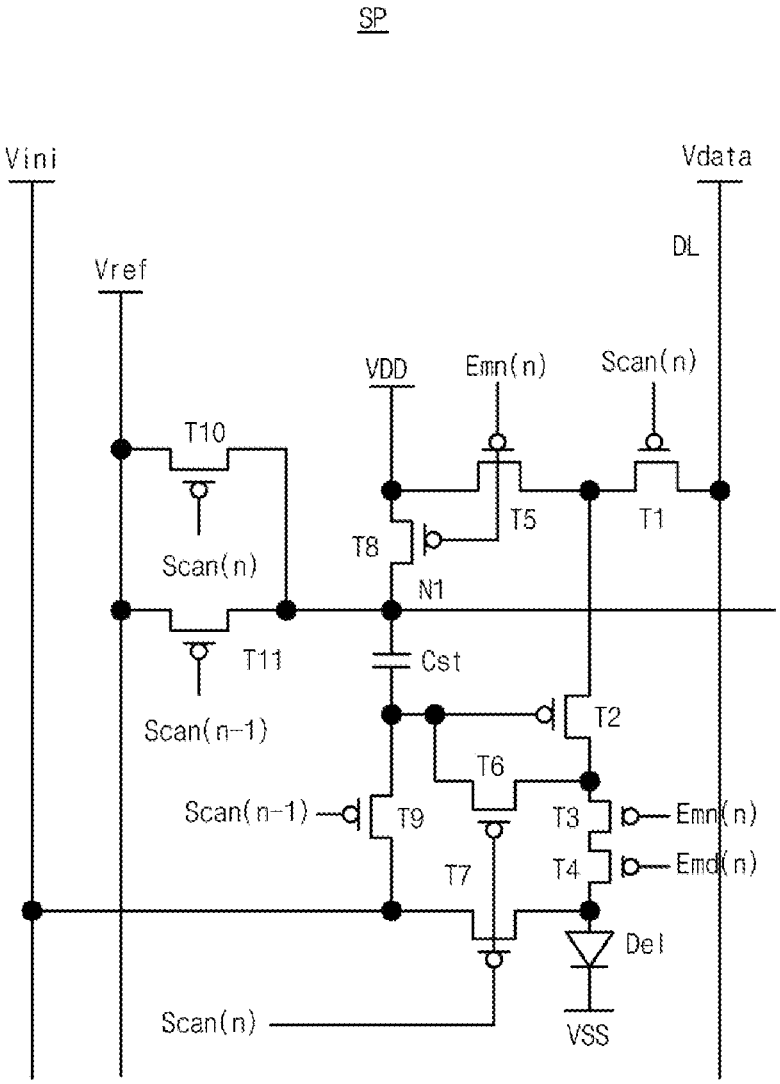
FIG. 5 is a view showing a subpixel of a display device according to a second embodiment of the present disclosure.

FIG. 5 is a view showing a subpixel of a display device according to a second embodiment of the present disclosure.

In FIG. 5, each of the red, green and blue subpixels SPr, SPg and SPb of the display panel 250 of the display device 210 according to a second embodiment of the present disclosure includes first to eleventh transistors T1 to T11, a storage capacitor Cst and a light emitting diode Del.

For example, the first to eleventh transistors T1 to T11 may have a positive (P) type.

The first transistor T1 of a switching transistor may be switched according to an (n)th gate voltage Scan(n) to transmit a data voltage Vdata. A gate electrode of the first transistor T1 receives the (n)th gate voltage Scan(n) of an (n)th gate line, a source electrode of the first transistor T1 is connected to a data line DL, and a drain electrode of the first transistor T1 is connected to source electrodes of the second and fifth transistors T2 and T5.

The second transistor T2 of a driving transistor may be switched according to a voltage of a first electrode of the storage capacitor Cst. A gate electrode of the second transistor T2 is connected to the first electrode of the storage capacitor Cst, a drain electrode of the sixth transistor T6 and a source electrode of the ninth transistor T9, a source electrode of the second transistor T2 is connected to a drain electrode of the first transistor T1 and a source electrode of the fifth transistor T5, and a drain electrode of the second transistor T2 is connected to source electrodes of the third and sixth transistors T3 and T6.

The third transistor T3 may be switched according to an (n)th normal emission voltage Emn(n). A gate electrode of the third transistor T3 receives the (n)th normal emission voltage Emn(n), a source electrode of the third transistor T3 is connected to a drain electrode of the second transistor T2 and a source electrode of the sixth transistor T6, and a drain electrode of the third transistor T3 is connected to a source electrode of the fourth transistor T4.

The fourth transistor T4 may be switched according to an (n)th duty emission voltage Emd(n). A gate electrode of the fourth transistor T4 receives the (n)th duty emission voltage Emd(n), a source electrode of the fourth transistor T4 is connected to a drain electrode of the third transistor T3, and a drain electrode of the fourth transistor T4 is connected to a source electrode of the seventh transistor T7 and an anode of the light emitting diode Del.

The fifth transistor T5 may be switched according to an (n)th normal emission voltage Emn(n). A gate electrode of the fifth transistor T5 receives the (n)th normal emission voltage Emn(n), a source electrode of the fifth transistor T5 is connected to a drain electrode of the first transistor T1 and a source electrode of the second transistor T2, and a drain electrode of the fifth transistor T5 receives a high level voltage VDD and is connected to a source electrode of the eighth transistor T8.

The sixth transistor T6 may be switched according to an (n)th gate voltage Scan(n). A gate electrode of the sixth transistor T6 receives the (n)th gate voltage Scan(n), a source electrode of the sixth transistor T6 is connected to a drain electrode of the second transistor T2 and a source electrode of the third transistor T3, and a drain electrode of the sixth transistor T6 is connected to a gate electrode of the second transistor T2, a first electrode of the storage capacitor Cst and a source electrode of the ninth transistor T9.

The seventh transistor T7 may be switched according to an (n)th gate voltage Scan(n). A gate electrode of the seventh transistor T7 receives the (n)th gate voltage Scan(n), a source electrode of the seventh transistor T7 is connected to a drain electrode of the fourth transistor T4 and an anode of the light emitting diode Del, and a drain electrode of the seventh transistor T7 receives an initialization voltage Vini and is connected to a drain electrode of the ninth transistor T9.

The eighth transistor T8 may be switched according to an (n)th normal emission voltage Emn(n). A gate electrode of the eighth transistor T8 receives the (n)th normal emission voltage Emn(n), a source electrode of the eighth transistor T8 receives the high level voltage VDD, and a drain electrode of the eighth transistor T8 is connected to a second electrode of the storage capacitor Cst and source electrodes of the tenth and eleventh transistors T10 and T11.

The ninth transistor T9 may be switched according to an (n−1)th gate voltage Scan(n−1). A gate electrode of the ninth transistor T9 receives the (n−1)th gate voltage Scan(n−1), a source electrode of the ninth transistor T9 is connected to a first electrode of the storage capacitor Cst, a gate electrode of the second transistor T2 and a drain electrode of the sixth transistor T6, and a drain electrode of the ninth transistor T9 receives an initialization voltage Vini and is connected to a drain electrode of the seventh transistor T7.

The tenth transistor T10 may be switched according to an (n)th gate voltage Scan(n). A gate electrode of the tenth transistor T10 receives the (n)th gate voltage Scan(n), a source electrode of the tenth transistor T10 is connected to a second electrode of the storage capacitor Cst and a drain electrode of the eighth transistor T8, and a drain electrode of the tenth transistor T10 receives a reference voltage Vref.

The eleventh transistor T11 may be switched according to an (n−1)th gate voltage Scan(n−1). A gate electrode of the eleventh transistor T11 receives the (n−1)th gate voltage Scan(n−1), a source electrode of the eleventh transistor T11 is connected to a second electrode of the storage capacitor Cst and a drain electrode of the eighth transistor T8, and a drain electrode of the eleventh transistor T11 receives a reference voltage Vref.

The light emitting diode Del is connected between the fourth transistor T4 and a low level voltage VSS and emits a light of a luminance proportional to a current of the second transistor T2.

The light emitting diode Del emits the light according to operation of the first to eleventh transistors T1 to T11 and the storage capacitor Cst to display an image. In addition, the display device 210 may compensate variation of a threshold voltage or deterioration of the light emitting diode according to a duration time using the subpixel. In addition, the display device 210 may control a luminance by driving the light emitting diode Del according to a duty ratio corresponding to an emission time.

When the display device 210 is driven in a duty mode, emission of the light emitting diode Del is maintained or stopped according to the (n)th duty emission voltage Emd (n). When the display device 210 is driven in a normal mode, emission of the light emitting diode Del is maintained or stopped according to the (n)th duty emission voltage Emd(n) having the same wave form as the (n)th normal emission voltage Emn(n).

When the display device 210 is driven in a duty mode according to a duty ratio, during an off period of a non-emission period, the (n)th duty emission voltage Emd(n) becomes a relatively high voltage such that the fourth transistor T4 is turned off and the light emitting diode Del does not emit a light, and the (n)th normal emission voltage Emn(n) is kept as a relatively low voltage such that the eighth transistor T8 is turned on and the first node N1 is kept at the high level voltage VDD.

As a result, even when the display device 210 is driven in a duty mode according to a duty ratio, the first node N1 of the red, green and blue subpixels SPr, SPg and SPb connected to each other through the transmission line may not have a floating state and may be kept as the high level voltage VDD. Accordingly, a coupling due to a parasitic capacitance generated by overlapping of the transmission line and the data line of each subpixel is prevented, and variation of the first red, first blue and second green data voltages Vr1, Vb1 and Vg2 charged in each subpixel is prevented.

The data driving part, the gamma part and the display panel of the display device 210 will be illustrated with reference to drawings.

Figure 6:
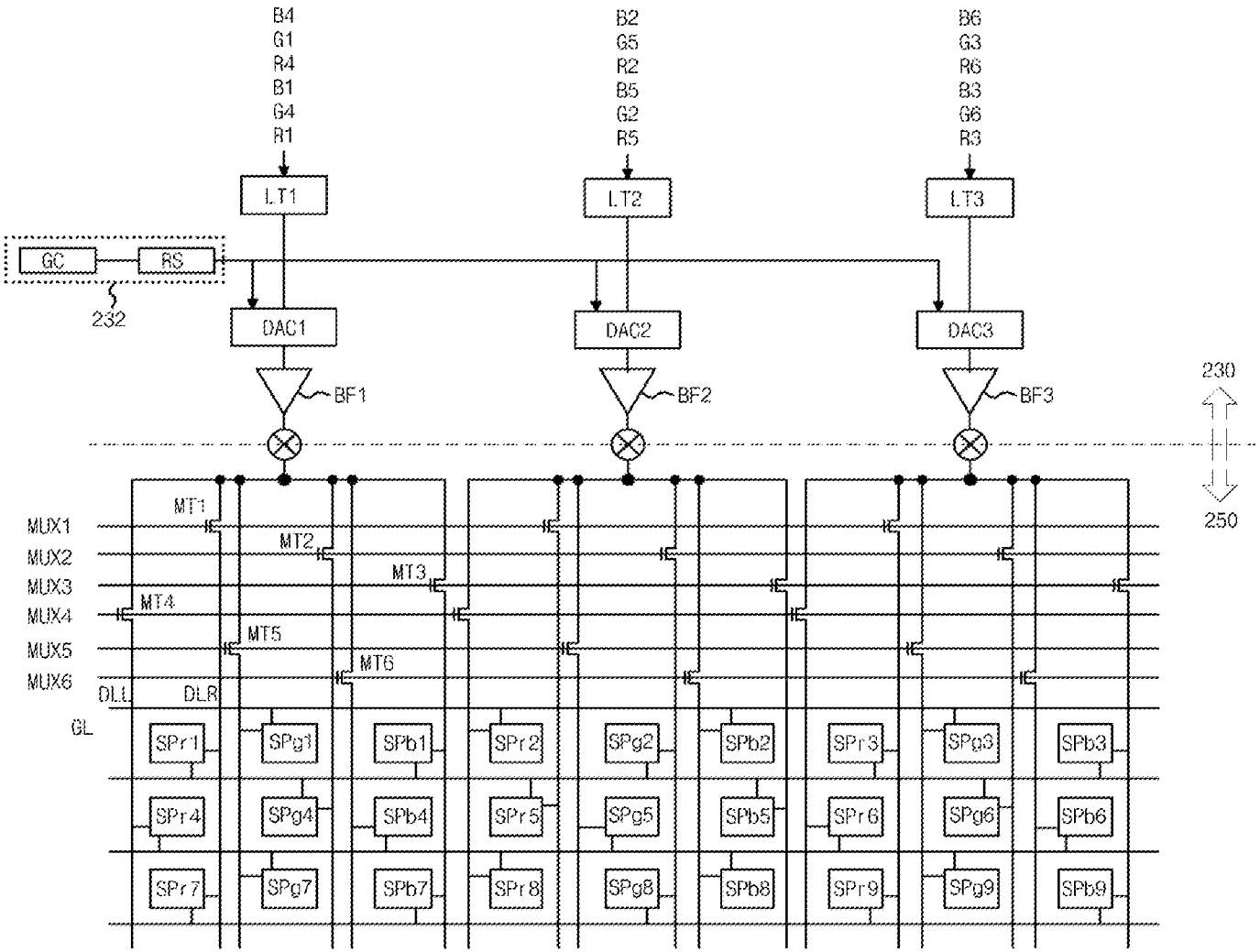
FIG. 6 is a view showing a data driving part, a gamma part and a display panel of a display device according to a second embodiment of the present disclosure.

FIG. 6 is a view showing a data driving part, a gamma part and a display panel of a display device according to a second embodiment of the present disclosure.

In FIG. 6, the data driving part 230 of the display device 210 according to a second embodiment of the present disclosure may include a plurality of latches LT1 to LT3, a plurality of digital analog converters DAC1 to DAC3 and a plurality of buffers BF1 to BF3. The gamma part 232 of the display device 210 according to a second embodiment of the present disclosure may include a gamma circuit GC and a resistor string RS. The display panel 250 of the display device 210 according to a second embodiment of the present disclosure may include a plurality of first MUX switches MT1, a plurality of second MUX switches MT2, a plurality of third MUX switches MT3, a plurality of fourth MUX switches MT4, a plurality of fifth MUX switches MT5, a plurality of sixth MUX switches MT6, a plurality of red subpixels SPr, a plurality of green subpixels SPg and a plurality of blue subpixels SPb.

The data driving part 230 may be connected to a non-display area surrounding a display area of the display panel 250. The plurality of first MUX switches MT1, the plurality of second MUX switches MT2, the plurality of third MUX switches MT3, the plurality of fourth MUX switches MT4, the plurality of fifth MUX switches MT5 and the plurality of sixth MUX switches MT6 may be disposed in the non-display area of the display panel 250.

The plurality of latches LT1 to LT3 sequentially receive image data of each color from the timing controlling part 220 and store the image data of each color for a time corresponding to one clock. Next, the plurality of latches LT1 to LT3 sequentially output the image data of each color to the plurality of digital analog converters DAC1 to DAC3.

A method of applying the plurality of image data to the plurality of red subpixels SPr, the plurality of green subpixels SPg and the plurality of blue subpixels SPb in the third and fourth horizontal pixel lines is the same as a method of applying the plurality of image data to the plurality of red subpixels SPr, the plurality of green subpixels SPg and the plurality of blue subpixels SPb in the first and second horizontal pixel lines. As a result, the first to sixth red image data R1 to R6, the first to sixth green image data G1 to G6 and the first to sixth blue image data B1 to B6 applied to the plurality of red subpixels SPr, the plurality of green subpixels SPg and the plurality of blue subpixels SPb in the first and second horizontal pixel lines will be exemplarily illustrated.

For example, first red, fourth green, first blue, fourth red, first green and fourth blue image data R1, G4, B1, R4, G1 and B4 may be sequentially inputted to and sequentially outputted from the first latch LT1. Fifth red, second green, fifth blue, second red, fifth green and second blue image data R5, G2, B5, R2, G5 and B2 may be sequentially inputted to and sequentially outputted from the second latch LT2. Third red, sixth green, third blue, sixth red, third green and sixth blue image data R3, G6, B3, R6, G3 and B6 may be sequentially inputted to and sequentially outputted from the third latch LT3.

The plurality of digital analog converters DAC1 to DAC3 convert the image data inputted from the plurality of latches LT1 to LT3 into a data voltage and sequentially output the data voltage.

For example, the first digital analog converter DAC1 may convert the first red, fourth green, first blue, fourth red, first green and fourth blue image data R1, G4, B1, R4, G1 and B4 of the first latch LT1 into first red, fourth green, first blue, fourth red, first green and fourth blue data voltages Vr1, Vg4, Vb1, Vr4, Vg1 and Vb4 and may transmit the first red, fourth green, first blue, fourth red, first green and fourth blue data voltages Vr1, Vg4, Vb1, Vr4, Vg1 and Vb4 to the first buffer BF1. The second digital analog converter DAC2 may convert the fifth red, second green, fifth blue, second red, fifth green and second blue image data R5, G2, B5, R2, G5 and B2 of the second latch LT2 into fifth red, second green, fifth blue, second red, fifth green and second blue data voltages Vr5, Vg2, Vb5, Vr2, Vg5 and Vb2 and may transmit the fifth red, second green, fifth blue, second red, fifth green and second blue data voltages Vr5, Vg2, Vb5, Vr2, Vg5 and Vb2 to the second buffer BF2. The third digital analog converter DAC3 may convert the third red, sixth green, third blue, sixth red, third green and sixth blue image data R3, G6, B3, R6, G3 and B6 of the third latch LT3 into third red, sixth green, third blue, sixth red, third green and sixth blue data voltages Vr3, Vg6, Vb3, Vr6, Vg3 and Vb6 and may transmit the third red, sixth green, third blue, sixth red, third green and sixth blue data voltages Vr3, Vg6, Vb3, Vr6, Vg3 and Vb6 to the third buffer BF3.

The plurality of digital analog converters DAC1 to DAC3 convert the image data into the data voltages using the gamma circuit GC and the resistor string RS.

The gamma circuit GC may store a corresponding relation of the red, green and blue image data of a digital value and the data voltages of an analog value. The gamma circuits GC receive the red, green and blue image data from the plurality of digital analog converters DAC1 to DAC3 and control the resistor string RS to transmit the data voltages corresponding to the red, green and blue image data to the plurality of digital analog converters DAC1 to DAC3.

The resistor string RS may include a plurality of resistors connected to each other in series. The resistor string RS outputs the data voltages corresponding to the red, green and blue image data from connection nodes between adjacent two of the plurality of resistors to the plurality of digital analog converters DAC1 to DAC3.

Each of the plurality of digital analog converters DAC1 to DAC3 may convert the red, green and blue image data into the data voltage. The plurality of digital analog converters DAC1 to DAC3 may output the data voltages corresponding to the red, green and blue image data using one gamma circuit GC and one resistor string RS in a time division method. As a result, the plurality of digital analog converters DAC1 to DAC3 may be connected to one gamma circuit GC and one resistor string RS.

The plurality of buffers BF1 to BF3 stabilize the plurality of data voltages received from the plurality of digital analog converters DAC1 to DAC3 and sequentially output the plurality of data voltages through an output terminal (a channel).

For example, the first buffer BF1 may sequentially output the first red, fourth green, first blue, fourth red, first green, first green and fourth blue data voltages Vr1, Vg4, Vb1, Vr4, Vg1 and Vb4 of the first digital analog converter DAC1 through a first output terminal. The second buffer BF2 may sequentially output the fifth red, second green, fifth blue, second red, fifth green and second blue data voltages Vr5, Vg2, Vb5, Vr2, Vg5 and Vb2 of the second digital analog converter DAC2 through a second output terminal. The third buffer BF3 may sequentially output the third red, sixth green, third blue, sixth red, third green and sixth blue data voltages Vr3, Vg6, Vb3, Vr6, Vg3 and Vb6 of the third digital analog converter DAC3 through a third output terminal.

The plurality of first MUX switches MT1, the plurality of second MUX switches MT2, the plurality of third MUX switches MT3, the plurality of fourth MUX switches MT4, the plurality of fifth MUX switches MT5 and the plurality of sixth MUX switches MT6 sequentially transmit the plurality of data voltages outputted from the plurality of buffers BF1 to BF3 to the plurality of data lines DL according to first to sixth MUX signals MUX1 to MUX6.

For example, according to the first MUX signal MUX1, the plurality of first MUX switches MT1 may transmit the first red data voltage Vr1 of the first buffer BF1 to the first right data line DLR, may transmit the fifth red data voltage Vr5 of the second buffer BF2 to the fourth right data line DLR, and may transmit the third red data voltage Vr3 of the third buffer BF3 to the seventh right data line DLR.

According to the second MUX signal MUX2, the plurality of second MUX switches MT2 may transmit the fourth green data voltage Vg4 of the first buffer BF1 to the second right data line DLR, may transmit the second green data voltage Vg2 of the second buffer BF2 to the fifth right data line DLR, and may transmit the sixth green data voltage Vg6 of the third buffer BF3 to the eighth right data line DLR.

According to the third MUX signal MUX3, the plurality of third MUX switches MT3 may transmit the first blue data voltage Vb1 of the first buffer BF1 to the third right data line DLR, may transmit the fifth blue data voltage Vb5 of the second buffer BF2 to the sixth right data line DLR, and may transmit the third blue data voltage Vb3 of the third buffer BF3 to the ninth right data line DLR.

According to the fourth MUX signal MUX4, the plurality of fourth MUX switches MT4 may transmit the fourth red data voltage Vr4 of the first buffer BF1 to the first left data line DLL, may transmit the second red data voltage Vr2 of the second buffer BF2 to the fourth left data line DLL, and may transmit the sixth red data voltage Vr6 of the third buffer BF3 to the seventh left data line DLL.

According to the fifth MUX signal MUX5, the plurality of fifth MUX switches MT5 may transmit the first green data voltage Vg1 of the first buffer BF1 to the second left data line DLL, may transmit the fifth green data voltage Vg5 of the second buffer BF2 to the fifth left data line DLL, and may transmit the third green data voltage Vg3 of the third buffer BF3 to the eighth left data line DLL.

According to the sixth MUX signal MUX6, the plurality of sixth MUX switches MT6 may transmit the fourth blue data voltage Vb4 of the first buffer BF1 to the third left data line DLL, may transmit the second blue data voltage Vb2 of the second buffer BF2 to the sixth left data line DLL, and may transmit the sixth blue data voltage Vb6 of the third buffer BF3 to the ninth left data line DLL.

The plurality of red subpixels SPr, the plurality of green subpixels SPg and the plurality of blue subpixels SPb display an image using the plurality of data voltages transmitted through the plurality of first MUX switches MT1, the plurality of second MUX switches MT2, the plurality of third MUX switches MT3, the plurality of fourth MUX switches MT4, the plurality of fifth MUX switches MT5, the plurality of sixth MUX switches MT6, the plurality of left data lines DLL and the plurality of right data lines DLR.

Each of the red, green and blue subpixels SPr, SPg and SPb is connected to the data line DL and the gate line GL such that the source electrode of the first transistor T1 (of FIG. 2) in each of the red, green and blue subpixels SPr, SPg and SPb is connected to the left data line DLL or the right data line DLR and the gate electrode of the first transistor T1 (of FIG. 2) in each of the red, green and blue subpixels SPr, SPg and SPb is connected to the gate line GL.

For example, the first red, first green, first blue, second red, second green, second blue, third red, third green and third blue subpixels SPr1, SPg1, SPb1, SPr2, SPg2, SPb2, SPr3, SPg3 and SPb3 in a first horizontal pixel line may be connected to the second gate line and the first right data line, the first gate line and the second left data line, the second gate line and the third right data line, the first gate line and the fourth left data line, the second gate line and the fifth right data line, the first gate line and the sixth left data line, the second gate line and the seventh right data line, the first gate line and the eighth left data line, and the second gate line and the ninth right data line respectively, and emit lights of luminance corresponding to the first red, first green, first blue, second red, second green, second blue, third red, third green and third blue data voltages Vr1, Vg1, Vb1, Vr2, Vg2, Vb2, Vr3, Vg3 and Vb3, respectively. The fourth red, fourth green, fourth blue, fifth red, fifth green, fifth blue, sixth red, sixth green and sixth blue subpixels SPr4, SPg4, SPb4, SPr5, SPg5, SPb5, SPr6, SPg6 and SPb6 in a second horizontal pixel line may be connected to the third gate line and the first left data line, the second gate line and the second right data line, the third gate line and the third left data line, the second gate line and the fourth right data line, the third gate line and the fifth left data line, the second gate line and the sixth right data line, the third gate line and the seventh left data line, the second gate line and the eighth right data line, and the third gate line and the ninth left data line respectively, and emit lights of luminance corresponding to the fourth red, fourth green, fourth blue, fifth red, fifth green, fifth blue, sixth red, sixth green and sixth blue data voltages Vr4, Vg4, Vb4, Vr5, Vg5, Vb5, Vr6, Vg6 and Vb6, respectively. The seventh red, seventh green, seventh blue, eighth red, eighth green, eighth blue, ninth red, ninth green and ninth blue subpixels SPr7, SPg7, SPb7, SPr8, SPg8, SPb8, SPr9, SPg9 and SPb9 in a third horizontal pixel line may emit lights of luminance corresponding to the seventh red, seventh green, seventh blue, eighth red, eighth green, eighth blue, ninth red, ninth green and ninth blue data voltages Vr7, Vg7, Vb7, Vr8, Vg8, Vb8, Vr9, Vg9 and Vb9, respectively.

In the first and second horizontal pixel lines, through the right data line DLR, the first red, fifth red and third red data voltages Vr1, Vr5 and Vr3 are simultaneously transmitted to the first red, fifth red and third red subpixels SPr1, SPr5 and SPr3, respectively. Next, through the right data line DLR, the fourth green, second green and sixth green data voltages Vg4, Vg2 and Vg6 are simultaneously transmitted to the fourth green, second green and sixth green subpixels SPg4, SPg2 and SPg6, respectively. Next, through the right data line DLR, the first blue, fifth blue and third blue data voltages Vb1, Vb5 and Vb3 are simultaneously transmitted to the first blue, fifth blue and third blue subpixels SPb1, SPb5 and SPb3, respectively.

In the first and second horizontal pixel lines, through the left data line DLL, the fourth red, second red and sixth red data voltages Vr4, Vr2 and Vr6 are simultaneously transmitted to the fourth red, second red and sixth red subpixels SPr4, SPr2 and SPr6, respectively. Next, through the left data line DLL, the first green, fifth green and third green data voltages Vg1, Vg5 and Vg3 are simultaneously transmitted to the first green, fifth green and third green subpixels SPg1, SPg5 and SPg3, respectively. Next, through the left data line DLL, the fourth blue, second blue and sixth blue data voltages Vb4, Vb2 and Vb6 are simultaneously transmitted to the fourth blue, second blue and sixth blue subpixels SPb4, SPb2 and SPb6, respectively.

As a result, in each of the plurality of horizontal pixel lines, the data voltage is transmitted to the red, green and blue subpixels SPr, SPg and SPb alternately through the left data line DLL and the right data line DLR, and a sufficient charging time of the data voltage to the data line is obtained.

While the data voltage is applied to the present subpixel through the left data line DLL, the data voltage may be applied to the right data line DLR such that the right data line DLR is pre-charged. As a result, a time of applying the data voltage to the subpixel is reduced due to the pre-charged right data line DLR, and a sampling time corresponding to one horizontal period is additionally obtained.

In the display device 210 according to a second embodiment of the present disclosure, the plurality of data voltages sequentially outputted from one output terminal (one channel) of the data driving part 230 are sequentially transmitted to the three adjacent subpixels in one horizontal pixel line through the plurality of first MUX switches MT1, the plurality of second MUX switches MT2, the plurality of third MUX switches MT3, the plurality of fourth MUX switches MT4, the plurality of fifth MUX switches MT5 and the plurality of sixth MUX switches MT6 of the display panel 250.

Accordingly, since the number of the output terminals (a number of pins) of the data driving part 230 is reduced, the number of the required data driving parts (integrated circuits) 230 is reduced and fabrication cost is reduced.

In the display device 210 according to a second embodiment of the present disclosure, the left data line DLL and the right data line DLR are disposed at the left side and the right side, respectively, of each subpixel, and the data voltages are transmitted to the red, green and blue subpixels SPr, SPg and SPb in one vertical pixel line alternately through the left data line DLL and the right data line DLR. As a result, a sufficient charging time of the data voltage for the data line is obtained.

Further, in the display device 210 according to a second embodiment of the present disclosure, since the red, green and blue data voltages are supplied using one gamma circuit GC and one resistor string RS in a time division method, the number of elements such as a gamma integrated circuit (PGMA IC) is reduced and fabrication cost is reduced.

Figure 7:
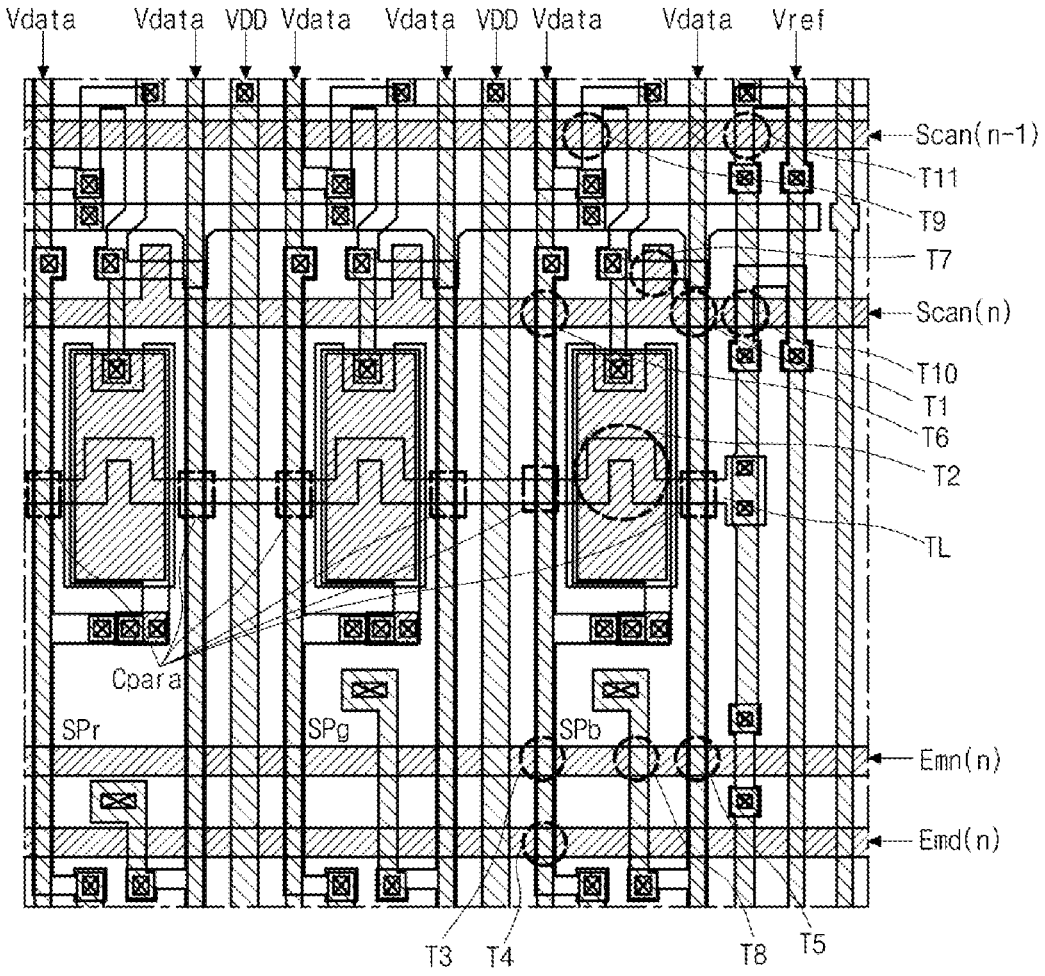
FIG. 7 is a plan view showing red, green and blue subpixels of a display device according to a second embodiment of the present disclosure.

FIG. 7 is a plan view showing red, green and blue subpixels of a display device according to a second embodiment of the present disclosure.

In FIG. 7, for simplification of driving elements, first nodes N1 (of FIG. 2) of the adjacent red, green and blue subpixels SPr, SPg and SPb are connected through a transmission line TL, and the reference voltage Vref is supplied to the red, green and blue subpixels SPr, SPg and SPb through a pair of the ninth and tenth transistors T9 and T10.

As a result, the transmission line TL and the data line DL of each of the red, green and blue subpixels SPr, SPg and SPb overlap each other to constitute a parasitic capacitance Cpara. Here, since the fourth transistor T4 switched according to the (n)th duty emission voltage Emd(n) as well as the third transistor T3 switched according to the (n)th normal emission voltage Emn(n) is disposed in each of the red, green and blue subpixels SPr, SPg and SPb, the first node N1 does not have a floating state and is kept as the high level voltage VDD. When the display device 210 is driven in a duty mode according to a duty ratio, during an off period of a non-emission period, the fourth transistor T4 is turned off according to the (n)th duty emission voltage Emd(n) of a high level and the light emitting diode Del does not emit a light. At the same time, the eighth transistor T8 is turned on according to the (n)th normal emission voltage Emn(n) of a low level and the high level voltage VDD is supplied to the first node N1. As a result, coupling due to parasitic capacitance generated by overlapping of the transmission line TL and the data line DL of each subpixel is prevented, and variation of the data voltage Vdata charged in each subpixel is prevented.

Consequently, in the display device according to the present disclosure, since the data voltage is supplied to the subpixel of the display panel through a dual data line of the left data line and the right data line, sufficient charging time (a sampling time) to the dual data line is obtained, the number of the data driving parts is reduced, and fabrication cost is reduced.

Further, since the data voltage sequentially outputted from one output terminal of the data driving part is supplied to three subpixels of the display panel using the MUX, the number of the gamma circuit is reduced and fabrication cost is reduced.

It will be apparent to those skilled in the art that various modifications and variation can be made in the present disclosure without departing from the spirit or scope of the disclosure. Thus, it is intended that the present disclosure cover the modifications and variations of this disclosure provided they come within the scope of the appended claims and their equivalents.

What is claimed is:

1. A display device comprising:

a timing controlling part generating an image data, a data control signal and a gate control signal;

a data driving part generating a data voltage using the image data and the data control signal;

a gamma part transmitting the data voltage corresponding to the image data;

a gate driving part generating a gate voltage using the gate control signal;

a display panel including a plurality of subpixels, a plurality of gate lines transmitting the gate voltage to the plurality of subpixels, a plurality of left data lines transmitting the data voltage to the plurality of subpixels and disposed at a left side of the plurality of subpixels and a plurality of right data lines transmitting the data voltage to the plurality of subpixels and disposed at a right side of the plurality of subpixels; and a plurality of first multiplexer (MUX) switches, a plurality of second MUX switches, a plurality of third MUX switches, a plurality of fourth MUX switches, a plurality of fifth MUX switches and a plurality of sixth MUX switches sequentially transmitting the data voltage to the plurality of left data lines and the plurality of right data lines;

wherein the plurality of subpixels include left and right subpixels adjacent to each other in a horizontal pixel line, the plurality of left data lines include an adjacent left data line, the plurality of right data lines include an adjacent right data line, and the plurality of gate lines including a first gate line and a second gate line that is positioned after the first gate line, wherein each of the left subpixel and right subpixel includes a respective switching transistor, a respective driving transistor that is connected to the respective switching transistor, and a respective light emitting element connected to the respective driving transistor, wherein the adjacent right data line and the adjacent left data line are disposed between the left subpixel and the right subpixel and the left subpixel and the right subpixel are between the first gate line and the second gate line, and the adjacent right data line and the second gate line are connected to the respective switching transistor included in the left subpixel without the second gate line being connected to the respective switching transistor of the right subpixel, and the adjacent left data line and the first gate line are connected to the respective switching transistor included in the right subpixel without the first gate line being to the respective switching transistor of the left subpixel.

2. The display device of claim 1, wherein the plurality of subpixels are alternately connected to the plurality of left data lines and the plurality of right data lines.

3. The display device of claim 2, wherein the plurality of subpixels are alternately connected to adjacent two of the plurality of gate lines.

4. The display device of claim 1, wherein the plurality of subpixels include first red, first green, first blue, second red, second green, second blue, third red, third green and third blue subpixels in a first horizontal pixel line and fourth red, fourth green, fourth blue, fifth red, fifth green, fifth blue, sixth red, sixth green and sixth blue subpixels in a second horizontal pixel line, wherein the plurality of gate lines include the first gate line, the second gate line, and a third gate line, wherein the plurality of left data lines include first to ninth left data lines, wherein the plurality of right data lines include first to ninth right data lines, wherein the first red subpixel is connected to the second gate line and the first right data line, the first green subpixel is connected to the first gate line and the second left data line, the first blue subpixel is connected to the second gate line and the third right data line, the second red subpixel is connected to the first gate line and the fourth left data line, the second green subpixel is connected to the second gate line and the fifth right data line, the second blue subpixel is connected to the first gate line and the sixth left data line, the third red subpixel is connected to the second gate line and the seventh right data line, the third green subpixel is connected to the first gate line and the eighth left data line, and the third blue subpixel is connected to the second gate line and the ninth right data line, and wherein the fourth red subpixel is connected to the third gate line and the first left data line, the fourth green subpixel is connected to the second gate line and the second right data line, the fourth blue subpixel is connected to the third gate line and the third left data line, the fifth red subpixel is connected to the second gate line and the fourth right data line, the fifth green subpixel is connected to the third gate line and the fifth left data line, the fifth blue subpixel is connected to the second gate line and the sixth right data line, the sixth red subpixel is connected to the third gate line and the seventh left data line, the sixth green subpixel is connected to the second gate line and the eighth right data line, and the sixth blue subpixel is connected to the third gate line and the ninth left data line.

5. The display device of claim 1, wherein the data voltage includes first to sixth red data voltages, first to sixth green data voltages and first to sixth blue data voltages, wherein the plurality of subpixels include first red, first green, first blue, second red, second green, second blue, third red, third green and third blue subpixels in a first horizontal pixel line and fourth red, fourth green, fourth blue, fifth red, fifth green, fifth blue, sixth red, sixth green and sixth blue subpixels in a second horizontal pixel line, wherein the plurality of left data lines include first to ninth left data lines, wherein the plurality of right data lines include first to ninth right data lines, wherein the plurality of first MUX switches, according to a first MUX signal, transmit the first red data voltage to the first red subpixel through the first right data line, transmit the fifth red data voltage to the fifth red subpixel through the fourth right data line, and transmit the third red data voltage to the third red subpixel through the seventh right data line, wherein the plurality of second MUX switches, according to a second MUX signal, transmit the fourth green data voltage to the fourth green subpixel through the second right data line, transmit the second green data voltage to the second green subpixel through the fifth right data line, and transmit the sixth green data voltage to the sixth green subpixel through the eighth right data line, wherein the plurality of third MUX switches, according to a third MUX signal, transmit the first blue data voltage to the first blue subpixel through the third right data line, transmit the fifth blue data voltage to the fifth blue subpixel through the sixth right data line, and transmit the third blue data voltage to the third blue subpixel through the ninth right data line, wherein the plurality of fourth MUX switches, according to a fourth MUX signal, transmit the fourth red data voltage to the fourth red subpixel through the first left data line, transmit the second red data voltage to the second red subpixel through the fourth left data line, and transmit the sixth red data voltage to the sixth red subpixel through the seventh left data line, wherein the plurality of fifth MUX switches, according to a fifth MUX signal, transmit the first green data voltage to the first green subpixel through the second left data line, transmit the fifth green data voltage to the fifth green subpixel through the fifth left data line, and transmit the third green data voltage to the third green subpixel through the eighth left data line, and wherein the plurality of sixth MUX switches, according to a sixth MUX signal, transmit the fourth blue data voltage to the fourth blue subpixel through the third left data line, transmit the second blue data voltage to the second blue subpixel through the sixth left data line, and transmit the sixth blue data voltage to the sixth blue subpixel through the ninth left data line.

6. The display device of claim 1, wherein the data driving part comprises:

a plurality of latches receiving and outputting the image data; and a plurality of digital to analog converters converting the image data sequentially outputted from the plurality of latches into the data voltage and sequentially outputting the data voltage.

7. The display device of claim 6, wherein the gamma part comprises:

a gamma circuit storing a corresponding relation of the image data and the data voltage; and a resistor string transmitting the data voltage corresponding to the image data to the plurality of digital to analog converters.

8. The display device of claim 7, wherein the data driving part further comprises a plurality of buffers connected between the plurality of digital analog to converters and a plurality of output terminals.

9. The display device of claim 7, wherein the image data includes first red to sixth red image data, first green to sixth green image data and first blue to sixth blue image data, and wherein the plurality of digital to analog converters include a first digital to analog converter receiving the first red, fourth green, first blue, fourth red, first green and fourth blue image data, a second digital to analog converter receiving the fifth red, second green, fifth blue, second red, fifth green and second blue image data, and a third digital to analog converter receiving the third red, sixth green, third blue, sixth red, third green and sixth blue image data.

10. The display device of claim 1, wherein each of the plurality of subpixels comprises:

a first transistor switched according to an (n)th gate voltage and transmitting the data voltage;

a second transistor switched according to a voltage of a first electrode of a storage capacitor and connected to the first transistor;

a third transistor switched according to an (n)th normal emission voltage and connected to the second transistor;

a fourth transistor switched according to an (n)th duty emission voltage and connected to the third transistor;

a fifth transistor switched according to the (n)th normal emission voltage and connected to the first transistor;

a sixth transistor switched according to the (n)th gate voltage and connected to the second and third transistors;

a seventh transistor switched according to the (n)th gate voltage and transmitting an initialization voltage;

an eighth transistor switched according to the (n)th normal emission voltage and transmitting a high level voltage;

a ninth transistor switched according to an (n−1)th gate voltage and transmitting the initialization voltage;

a tenth transistor switched according to the (n)th gate voltage and transmitting a reference voltage;

an eleventh transistor switched according to the (n−1)th gate voltage and transmitting the reference voltage; and a light emitting diode connected to the fourth transistor.

11. The display device of claim 1, wherein the plurality of subpixels include first red, first green and first blue subpixels in a horizontal pixel line, wherein the plurality of left data lines include first to third left data lines, wherein the plurality of right data lines include first to third right data lines, and wherein the first red subpixel is connected to the second gate line and the first right data line, the first green subpixel is connected to the first gate line and the second left data line, and the first blue subpixel is connected to the second gate line and the third right data line.

12. A method of driving a display device comprising:

generating an image data, a data control signal and a gate control signal;

generating a data voltage using the image data and the data control signal;

generating a gate voltage using the gate control signal;

sequentially transmitting the gate voltage to a plurality of data lines including a first gate line and a second gate line that is positioned after the first gate line;

sequentially transmitting the data voltage to a plurality of left data lines disposed at a left side of a plurality of subpixels and a plurality of right data lines disposed at a right side of the plurality of subpixels through a plurality of first multiplexer (MUX) switches, a plurality of second MUX switches, a plurality of third MUX switches, a plurality of fourth MUX switches, a plurality of fifth MUX switches and a plurality of sixth MUX switches; and displaying an image in the plurality of subpixels using the data voltage and the gate voltage, wherein the plurality of subpixels include left and right subpixels adjacent to each other along a horizontal direction, the plurality of left data lines include an adjacent left data line, and the plurality of right data lines include an adjacent left data line, and wherein each of the left subpixel and right subpixel includes a respective switching transistor, a respective driving transistor that is connected to the respective switching transistor, and a respective light emitting element connected to the respective driving transistor, wherein the adjacent right data line and the adjacent left data line are disposed between the left subpixel and the right subpixel and the left subpixel and the right subpixel are between the first gate line and the second gate line, and the adjacent right data line and the second gate line are connected to the respective switching transistor included in the left subpixel without the second gate line being connected to the respective switching transistor of the right subpixel, and the adjacent left data line and the first gate line are connected to the respective switching transistor included in the right subpixel without the first gate line being to the respective switching transistor of the left subpixel.

* * * * *